United States Patent [19]

Woodhull, Jr. et al.

[11] 4,381,033

[45] Apr. 26, 1983

[54] HEADER CONSTRUCTION

[75] Inventors: Ivan D. Woodhull, Jr., Flat Rock; Thomas H. Liedel, Maybee, both of Mich.

[73] Assignee: Karmazin Products Corporation, Wyandotte, Mich.

[21] Appl. No.: 250,541

[22] Filed: Apr. 3, 1981

Related U.S. Application Data

[63] Continuation of Ser. No. 884,368, Mar. 7, 1978, abandoned, which is a continuation-in-part of Ser. No. 789,411, Apr. 21, 1977, abandoned.

[51] Int. Cl.[3] ..... F28F 9/02

[52] U.S. Cl. ..... 165/175; 165/176

[58] Field of Search ..... 29/157.4; 165/76, 146, 165/147, 151, 153, 158, 159, 160, 161, 166, 173, 174, 175, 178, 176, 179

[56] References Cited

U.S. PATENT DOCUMENTS

| | | | |
|---|---|---|---|
| 513,620 | 1/1894 | Phillips | 29/157.4 |
| 1,468,692 | 9/1923 | Baker | 29/157.4 |
| 1,722,109 | 7/1929 | Potter | 165/160 |
| 1,803,034 | 4/1931 | Potter | 165/160 |
| 2,028,456 | 1/1936 | Karmazin | 165/166 |
| 2,045,657 | 6/1936 | Karmazin | 165/179 |
| 2,212,242 | 8/1940 | Nemmer et al. | 165/151 |
| 2,229,207 | 1/1941 | Hansen | 165/175 |
| 2,287,178 | 6/1942 | Johnston | 165/151 |
| 2,639,899 | 5/1953 | Young | 165/175 |
| 2,752,950 | 7/1956 | Coulters | 165/76 |
| 3,151,674 | 10/1964 | Heller et al. | 165/176 X |
| 3,195,626 | 7/1965 | Druseikis et al. | 165/179 |
| 3,250,323 | 5/1966 | Karmazin | 165/179 |
| 3,311,165 | 3/1967 | Karmazin | 165/179 |
| 3,478,821 | 11/1969 | Fieni | 165/151 |
| 3,515,208 | 6/1970 | Karmazin | 165/178 |
| 3,703,925 | 11/1971 | Ireland et al. | 165/151 |
| 3,710,858 | 1/1973 | Young | 165/173 |

FOREIGN PATENT DOCUMENTS

| | | | |
|---|---|---|---|
| 855414 | 9/1952 | Fed. Rep. of Germany | 165/134 |
| 766069 | 7/1954 | Fed. Rep. of Germany | 165/173 |
| 1962466 | 8/1977 | Fed. Rep. of Germany | 165/176 |
| 1425677 | 12/1966 | France | 165/173 |

*Primary Examiner*—Michael Koczo

*Attorney, Agent, or Firm*—Harness, Dickey & Pierce

[57] ABSTRACT

There is disclosed herein an improved header construction for use with fin and tube type heat exchangers which allows for an increased number of radiating fins to be incorporated into a heat exchanger of any predetermined size. This header construction includes a base member having a plurality of tubular projections extending outward from a center interconnecting portion and a pair of oppositely extending substantially parallel spaced apart flange portions extending generally perpendicular to the interconnecting portions. A cover member is also included which has an interconnecting portion with a pair of similarly generally perpendicularly outwardly projecting substantially parallel flange portions which are spaced apart a distance slightly less than the distance between the flange portions provided on the base member so as to be received between and adjacent to respective of the base member flange portions. An optional generally S-shaped clip member is provided which surrounds the lateral sides and end portions of each of these flange members and is brazed thereto to create a multisurface sealing relationship between the flange portions of the base member and cover member. The tubular projections provided on the base member are adapted to be directly connected to the respective tubes of the fin and tube heat exchanger so as to eliminate the need for any transition or intermedite header members thereby enabling this space to be used for additional heat radiating fin portions. Additionally, an optional longitudinally extending baffle and retaining clip assembly is disclosed which enables a single header assembly to provide both inlet and outlet header chambers. Thus, this header construction allows heat exchangers having increased heat radiating capacities to be fabricated within given dimensional sizes.

11 Claims, 12 Drawing Figures

HEADER CONSTRUCTION

This application is a continuation of application Ser. No. 884,368, filed Mar. 7, 1978, now abandoned, which is a continuation-in-part of application Ser. No. 789,411, filed Apr. 21, 1977, now abandoned.

BACKGROUND AND SUMMARY OF THE INVENTION

The present invention relates generally to heat exchangers such as are employed for various uses in transferring heat between non-mixing fluids and more particularly to improved header constructions for such heat exchangers of the fin and tube type construction.

Heat exchangers of various types are employed in a great variety of applications ranging from extraction of heat from combustion process such as for building heating to cooling of various fluids such as lubricants, compressed gases or the like. One heat exchanger construction commonly employed particularly in applications wherein a gaseous medium is to be passed over the exterior surface thereof is the fin and tube type construction. Typically such fin and tube type heat exchangers will have a plurality of fluid conducting tubes or conduits arranged in parallel side by side rows extending both longitudinally and transversely of the heat exchanger. Headers are generally connected to opposite ends of these tubes to conduct the fluid to the heat exchanger and the cooled fluid back to the source thereof.

In one form, these headers are fabricated from tubing or pipe of a diameter sufficiently large to provide the desired flow capacities. However, in large capacity heat exchangers having multiple longitudinal rows of tubes, it becomes impractical to directly connect each tube to the header. Thus, in such applications intermediate headers are often provided which interconnect transverse rows of tubes and provide a single longitudinal row of tubes for connection to the primary or main header. Such a construction is disclosed in U.S. Pat. No. 3,515,208, issued June 2, 1970 to J. Karmazin. As these intermediate headers are not generally provided with heat radiating fins, they do not provide an effective heat transfer surface area commensurate with the space which they occupy. Thus, in order to provide a heat exchanger having a given efficiency, it is necessary to increase the physical size thereof which necessitates increased costs in the form of additional framing members and further requires additional space for installation of such units.

Space limitations are becoming an ever-increasing problem particularly for heat exchangers which are designed for use in machinery manufactured for the heavy construction industry in that Federal regulations are requiring more and more pollution and noise abatement equipment of various types to be installed on such equipment. As this additional equipment often requires substantial space and further in that it is generally desirable to keep the overall size of such equipment as small as possible, the available space for installation of such heat exchangers is becoming significantly reduced. Further, the addition of such pollution equipment often requires substantial amounts of additional power be drawn from the engine which increases the amount of heat which must be dissipated by the heat exchanger while also restricting the amount of air which may be passed over the heat exchanger. Thus, not only is the available space for installation of such heat exchangers being reduced, but the demands for heat dissipating capacity are increasing. It therefore becomes important to provide heat exchangers having increased operating efficiencies in order to meet these reduced space requirements and increased heat dissipating requirements.

The present invention provides a header construction which overcomes these problems by eliminating the need for the intermediate header member. The present invention provides a base member which allows for direct connection of any number of longitudinally extending rows of tubes directly to the primary or main inlet and outlet headers thereby allowing the space previously consumed by these intermediate header members to be effectively used for additional heat radiating fin members. Further, the unique header construction allows a header to be fabricated of any desired width without concern that the flow capacity thereof may be either excessive or insufficient as the height of the header may be easily modified to provide any desired volume and hence flow rates therein. The header comprises two generally U-shaped channel members one of which has a width slightly less than the width of the other so as to allow the outwardly projecting flange portions thereof to nest between and adjacent to the outwardly projecting flange portions of the other member. A clip member may be employed between these adjacent flange portions and will serve to mechanically secure these adjacent flange portions together prior to and during an oven brazing operation as well as to provide a multisurfaced seal between these members. Alternatively, the adjacent flange portions may be mechanically secured by tack welding and thereafter sealed by a brazing operation. The base channel member is provided with a plurality of tubular projections extending outward therefrom which are adapted to telescopically receive or be received by the respective tubes from the fin and tube construction thereby allowing the fin portions to approach within a close proximity to the header itself. Further, these generally tubular projections are provided with a hydraulic radius at their junction with the base member so as to insure a smooth laminar fluid flow between the header and the tubes. Also, a unique baffle assembly is provided which enables a single header assembly to provide both inlet and outlet header chambers such as may be desirable for two pass counterflow heat exchanger.

Thus, the present invention allows fabrication of a heat exchanger having substantially greater numbers of heat radiating fins and therefore substantially greater capacity for a given size heat exchanger. Further, the header is extremely economical to construct and may be easily fabricated from whatever desired gauge channel or flat formed stock is necessary to resist the pressure forces which will be generated during operation thereof as well as providing a strong frame for supporting and protecting the core. Also, the use of the generally S-shaped clip member insures a high integrity joint as substantial amounts of brazing material will be deposited to create a positive, long-lasting and durable sealing relationship between the adjacent flange members and portions of the clip member.

Additional advantages and features of the present invention will become apparent from the subsequent description and the appended claims taken in conjunction with the accompanying drawings.

BRIEF DESCRIPTION OF THE DRAWINGS

FIG. 1 illustrates a heat exchanger of the fin and tube construction having inlet and outlet headers in accordance with the present invention;

FIG. 2 is an enlarged sectioned view of both the intake and outlet headers of FIG. 1, the section being taken along a vertical plane passing through the longitudinal axis of the heat exchanger of FIG. 1 and passing through the center of one transverse row of tubes;

FIG. 3 is an enlarged view of a portion of a fully assembled header in accordance with the present invention showing the clip member and overlapping flange portions prior to brazing and including a pair of brazing rods;

FIG. 4 is a view similar to that of FIG. 3 but illustrating the assembly after being subjected to a brazing process;

FIG. 5 is an enlarged cross sectional view of the clip member;

FIG. 6 is an enlarged sectioned view of a portion of a heat exchanger illustrating another embodiment of the present invention;

DESCRIPTION OF THE PREFERRED EMBODIMENTS

Figure 7:
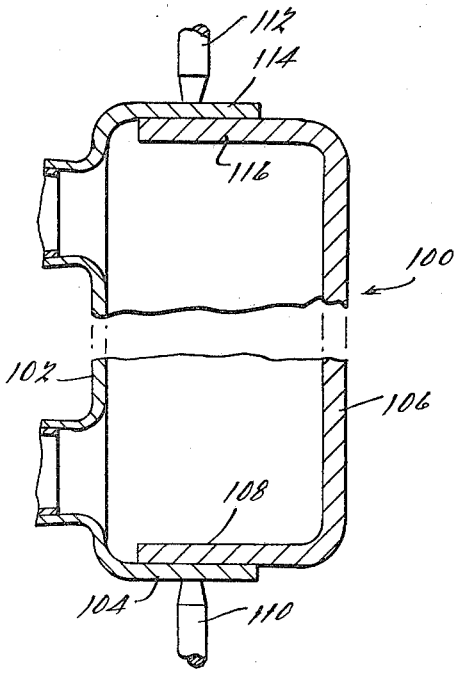
FIG. 7 is an enlarged fragmentary sectioned view of a portion of a header assembly in accordance with the present invention being subjected to a spot welding operation.

Referring now to FIGS. 1 and 2, there is shown a heat exchanger indicated generally at 10 having an inlet 12 and an outlet header 14 connected at opposite ends thereof and having a core portion 15 fabricated from a plurality of stacked sheets 16 each of which is formed with a plurality of tubular projections 18 telescopically arranged in a nesting relationship to define a plurality of fluid conducting conduits and surrounding heat dissipating fins 20. The construction of this stacked fin and tube core portion is described in greater detail below.

The intake header 12 is comprised of a base member 22 having a pair of leg or flange portions 24 and 26 projecting generally perpendicularly outward from an interconnecting portion 28 to form a generally U-shaped structure. Interconnecting portion 28 is formed with a plurality of spaced tapered tubular projections 30 extending outward therefrom in a direction opposite that of flange portions 24 and 26 each of which is connected to one of the conduits 18 forming in part the heat exchanger core 15. A cover member 32 is also provided which is shaped similarly to that of base member 22 having a pair of leg or flange portions 34 and 36 projecting generally perpendicularly outward from an interconnecting portion 38. However, interconnecting portion 38 has a width slightly less than the width of interconnecting portion 28 so as to allow both flange portions 34 and 36 to be placed between and immediately adjacent respective of flange portions 24 and 26.

Outlet header 14 disposed at the opposite end of heat exchanger core 15 is of a similar construction also comprising a base member 40 having a pair of leg or flange portions 42 and 44 projecting generally perpendicularly outward from an interconnecting portion 46. Also, similar to base member 22, interconnecting member 46 is formed with a plurality of tapered tubular projections 48 extending outward therefrom. A second cover member 49 is provided which is substantially identical to cover member 32 and therefore has like portions indicated by like numerals primed. Headers 12 and 14 are substantially identical in construction except for the shape of respective tubular projections 30 and 48 extending outward therefrom.

As best seen with reference to FIG. 2, base member 22 is provided with tubular projections 30 having a slightly converging outward taper. Each of these tubular projections is open at the outer end and preferably is integrally formed with interconnecting portion 28 such as by use of a stamping operation employing progressive dies or by any other suitable means. In order to assure a smooth laminar fluid flow between the header and each of the tubular projections, a rounded shoulder portion 50 is provided at the juncture of each of tubular projections 30 with interconnecting portion 28. The outer terminal end portion 52 of each of these tubular projections is open and provided with a slight radially inwardly annular beveled edge 54 which facilitates the assembly operation by guiding tubular projections 30 into a telescopic nesting relationship with the outer ends 54 of the core portion conduits.

In order to facilitate assembly of base member 22 and cover member 32 and also to insure a fluid tight seal is created therebetween, a clip member 56 is interposed between the adjacent flange portions 24, 34, 26 and 36 respectively of base member 22 and cover member 32. Clip member 56 is generally S-shaped having three spaced apart substantially parallel interconnected portions 58, 60 and 62 which define two relatively deep slots 64 and 66 therebetween. Flange portions 24 and 26 of the base member 22 are received in slots 64 and engage outer portion 58 and intermediate portion 60 of clip member 56 while flange portions 34 and 36 of the cover member are received in respective slots 66 and engage inner portions 62 and the intermediate portion 60 of the clip member. Clip member 56 will generally be of a length coextensive with each of the base and cover members and will preferably be fabricated from a metal material such as steel for example.

Referring now to the outlet header 14, as also best seen in FIG. 2, tubular projections 48 of base member 40 are provided with a diverging outward taper which enables them to telescopically receive tubular projections 18 of the core portion 15 interiorly thereof. Also, similar to that of base member 22, the juncture between tubular projections 48 and interconnecting portion 46 of base member 40 are provided with a rounded annular shoulder 67 so as to insure a smooth fluid flow from the heat exchanger conduits into the header thereby maximizing the fluid flow through the heat exchanger.

While the header construction illustrated in FIG. 2 is suitable for use in any conventional fin and tube type heat exchanger core construction, it is particularly desirable in a construction wherein the fins and tube portions are integrally formed by fabricating a plurality of sheets each having integrally formed tapered tubular projections which are then stacked with each of the tapered tubular projections being arranged in a mutual aligned nested relationship so as to define a conduit therethrough. Typically, such constructions are fabricated by first manufacturing the plurality of integrally formed tube and fin members and stacking them in a substantially parallel nested relationship. The two base members 22 and 40 are then assembled to the core structure after which a cover member and associated clip members may be assembled to one of the base members by first assembling two clip members to each of the flange members of the base member. As seen in FIG. 3, a pair of brazing rods 68 and 70 of a length substantially equal to that of the respective flange portions and clip members are also inserted in each of the slots 64 and 66 between the terminal end portions 72 and 74 of respective flange portions 26 and 36 so as to be retained in place thereby. Thereafter a plurality of brazing rods are inserted in each of the conduits of the core 15. The other header assembly may then be completed in substantially the same manner as described above. A framing member 75 which extends parallel to the nested tubular projections 18 and between each of the two headers may then be welded to the opposite ends of headers 12 and 14 to retain the heat exchanger assembly together during the brazing operation. Framing members 75 also serve to prevent distortion of the core structure during the brazing operation as well as providing a mounting structure to secure the completed heat exchanger within whatever equipment it is intended to be used. Once the header and core structure is fully assembled as described above with the brazing rods appropriately placed therein, the entire structure is slowly moved through a brazing furnace at which time the brazing rods 68 and 70 will melt causing the material therein to flow between adjacent surfaces of the flange portions 26 and 36 and portions 50, 60 and 62 of clip member 56 and seal each of the joints. As best seen in FIG. 4, the brazing rod material 70 flows completely around the end portion 74 and side surfaces 76 and 78 of flange portion 36 as well as the facing surfaces of portions 62 and 60 of clip member 56 thereby forming a very long sealing surface between the interior and exterior of the header. Similarly, brazing rod material 68 flows completely around end portion 72 and side surfaces 80 and 82 of flange portion 26 as well as facing surfaces of portion 58 and 60 of clip member 56 thereby forming a similar extremely long sealing surface for the base member of the header.

It should also be noted that the cover members 32 and 49 of these headers may be provided with any desired number and type of connections such as for incoming and outgoing fluid conduits as well as drain plugs or the like in any desired conventional manner.

While any suitable material may be used for fabricating clip member 56, it has been found that for use in such a brazing operation a steel base material 84 having a relatively thin copper coating 86 completely surrounding the exterior surfaces thereof, as shown in FIG. 5, produces excellent results in that the copper coating combines with the brazing rod to form an extremely strong, durable bond between the adjacent flange portions. Further, the S-shape of the clip serves to mechanically retain the leg portions in a close relationship during the brazing process thereby preventing any deformation of the leg portions from their generally perpendicular position with respect to their connecting portions which may result in an incomplete or weakened seal therebetween.

While only three laterally spaced apart rows of core tubes are provided in the embodiment illustrated and described herein, it is possible to manufacture heat exchangers having any desired number of laterally spaced rows by merely extending the width of both the base and cover member. Further, the header itself may be easily designed to accommodate any header flow capacity necessary for a specific application by merely increasing the length of the flange portions of the cover member thereby providing a greater enclosed volume.

It should also be noted that while the headers have been described herein for use with heat exchanger cores comprising stacked sheets having integrally formed nesting tubular projections, the same construction and assembly method may be used in any type heat exchanger having cores which include fluid conducting tubes which must be connected to a header.

Typically the end portions of the header construction will be closed by welding plates thereover or forming flange portions on the base member and/or cover member and welding or brazing the seams. The individual components of this header construction may be fabricated of any desired material suitable for the particular application such as for example a steel of relatively heavy gauge. The use of the heavy gauge will assist in preventing the header from deforming should excessive pressure build up in the heat exchanger during use. Further, the fact that double seals are provided between the adjacent leg portions of the base member and interconnecting member will also assist in preserving the integrity of the header should this pressure develop during use.

Referring now to FIGS. 6 through 9, there is shown a portion of another embodiment of a heat exchanger 88 in accordance with the present invention comprising a core structure 90 of the fin and tube construction similar to that of core structure 15 described above including heat radiating fins 92 and integrally formed nested tubular projections 94. However, in this embodiment, each of the tubular projections 94 are provided with a diametrically extending portion 96 having a pair of vanes 98 provided thereon. This vaned tube construction is substantially identical to that disclosed in U.S. Pat. No. 3,311,165 issued Mar. 28, 1967 to J. Karmazin which disclosure is incorporated herein by reference. Heat exchanger 88 also includes a header 100 comprising a base member 102 having a flange portion 104 and cover member 106 having a flange portion 108 overlapping flange portion 104 all of which is substantially identical to that described with reference to base member 40 and cover member 49 except in this embodiment no clip member is employed. Rather, overlapping flange portions 104 and 108 are brought into mutual engagement and retained together by tack welding these portions together. Preferably, the tack welding will be accomplished by spot welding flange portions 104 and 108 together at a plurality of spaced apart locations along the length thereof.

Figure 8:
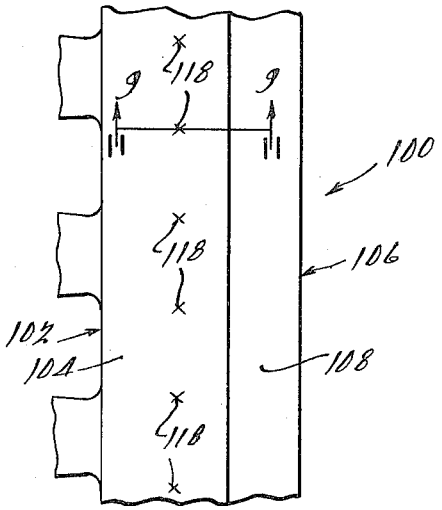
FIG. 8 is an enlarged fragmentary side elevational view of a portion of the header assembly illustrated in FIG. 7.
Figure 9:
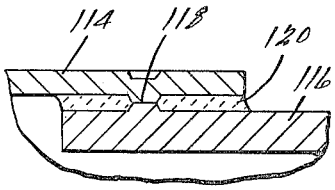
FIG. 9 is an exaggerated sectional view of the header assembly of FIG. 8, the section being taken along line 9—9 thereof.

As illustrated in FIGS. 7 through 9, this spot welding operation may be performed by bringing a pair of electrodes 110 and 112 into engagement with opposed flange portions 104 and 114 of base member 102 after cover member 106 has been assembled thereto with flange portions 108 and 116 in overlapping relationship therewith. A slight clamping pressure may be exerted on flanges 104 and 114 by electrodes 110 and 112 so as to force them into engagement with respective adjacent flanges 108 and 116. As voltage is applied between electrodes 110 and 112, current will flow through both base member 102 and cover member 106. The current concentrations in the area immediately surrounding respective electrodes 110 and 112 will cause a welding between adjacent flange portions 104, 108 and 114, 116. Preferably, a plurality of spot welds 118 will be applied to the header assembly at spaced apart locations along the entire length thereof, the spacing being sufficient to insure that the overlapping flange portions are maintained in close proximity to each other. Adjacent flange portions 104, 108 and 114, 116 may then be sealed by a brazing process which will result in a deposit of brazing material 120 being drawn and/or flowing between the overlapping mutually engaging surfaces of these flange portions and around spot welds 118 so as to effectively and securely seal the joint therebetween. The spot welding of these flange portions will not only retain them in close proximity to one another during the brazing process thereby insuring that the brazing material will be able to create a strong seal along substantially the entire overlapped surface but will also add strength to the completed header construction. In order to insure sufficient brazing material is present at these locations it may be desirable to place a small quantity of copper paste along the exterior seam between flanges 104 and 108 along with a brazing rod. The copper paste will serve to retain the brazing rod in position during the brazing operation. The method of assembling header member 88 to core structure 90 is substantially identical to that described above with reference to the headers of FIG. 2. It should also be noted that a base member 102 includes substantially identical tubular projections as those provided on base member 40.

As is apparent from the above description, the use of this header construction eliminates the need for the previously mentioned intermediate header members thus allowing the space occupied by such members to be more effectively utilized by heat radiating fins thereby allowing the efficiency of a given sized heat exchanger to be substantially increased. Further, the total number of joints in the heat exchanger is reduced and as these joints represent the weakest link, the overall integrity of the heat exchanger is also improved. Also, the forming of the tubular projections integrally with the base member enables the juncture to be easily formed with a smoothly merging radius which promotes maximum fluid flow between the conduits and headers.

Figure 10:
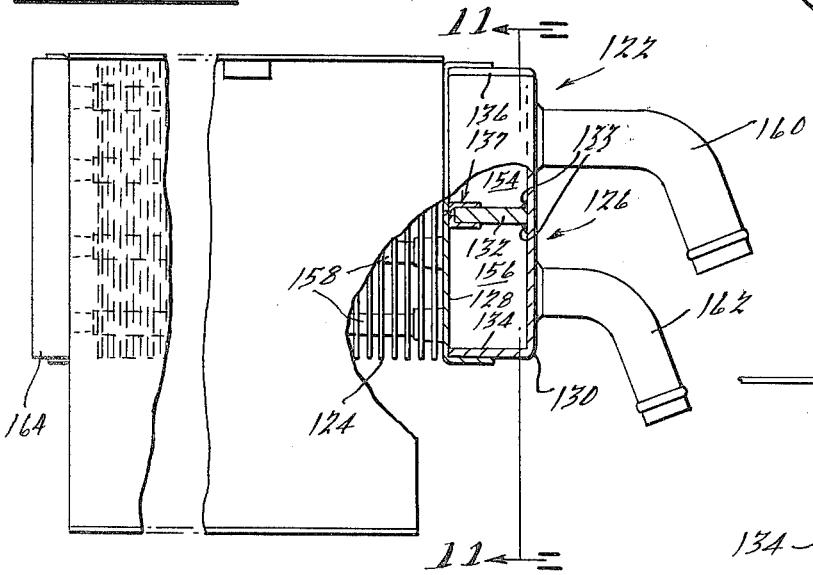
FIG. 10 is a side elevational view of a heat exchanger having a portion thereof broken away and illustrating another embodiment of the present invention.
Figure 11:
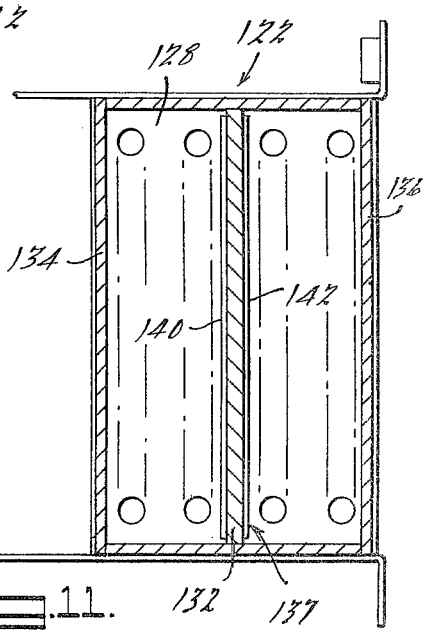
FIG. 11 is a transverse sectional view of the header assembly illustrated in FIG. 10, the section being taken along line 11—11 thereof.
Figure 12:
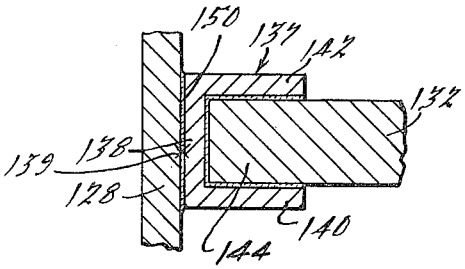
FIG. 12 is an enlarged detail view of a portion of the header assembly illustrated in FIG. 10.

Referring now to FIGS. 10 through 12 yet another embodiment of the present invention is illustrated being indicated generally at 122. In this embodiment heat exchanger 122 comprises a core portion 124 of the fin and tube type having a header assembly 126 secured to one end thereof. Header assembly 126 includes a base member 128 substantially identical to base members 28, 46 and 102 described above and therefore further description thereof is omitted as being unnecessarily redundant. Similarly, a cover member 130 is also provided which is substantially identical to cover member 38, 38' and 106 and therefore further description of which is believed unnecessary. However, in this embodiment, cover member 130 is provided with an additional centrally disposed longitudinally extending flange portion 132 arranged in substantially parallel spaced relationship to outer flange portions 134 and 136. Flange portion 132 will preferably be fixedly secured to cover member 130 by welding such as is indicated at 133 or in any other suitable manner so as to provide a fluid tight seal along its entire length. A generally U-shaped channel member 137 is also provided having a flat bottom portion 138 which is secured to base member 128 and from which a pair of slightly spaced apart flange portions 140 and 142 project outwardly so as to define a channel therebetween. Flange portions 140 and 142 are spaced apart a distance substantially equal to or only slightly greater than the thickness of flange portion 132, the outer end 144 of which is adapted to be received therebetween. Preferably, channel member 137 will be secured to base member 128 by spot welding as indicated at 139. A suitable copper paste or other brazing material 148 may be applied between end 144 of flange portion 132 and channel member 137 at the time of assembly of cover member 130 to base member 128. Thereafter, the header assembly may be completed by either spot welding technique as described above or alternatively the S-clip may be employed in the above described manner. As the completely assembled heat exchanger 122 is subjected to an oven brazing operation, brazing material 148 will flow around end portion 144 thereby forming a fluid tight seal with channel member 137. Additional brazing material 150 will be allowed to flow between bottom portion 138 and base member 128 so as to create a fluid tight seal therebetween.

Thus, flange portion 132 will separate header assembly 126 into two separate chambers 154, 156, each of which communicates with a predetermined number of fluid conduits 158 making up core 124. Suitable inlet and outlet connections 160, 162 may be provided communicating with respective chambers 154, 156 and a suitable fluid return 164 provided at the opposite end of fluid conduits 158 thereby providing a two pass counterflow heat exchanger having a single header assembly having both inlet and outlet chambers associated therewith. Additionally, it should be noted that flange portion 132 not only operates to divide header assembly 126 into separate chambers but also acts as a reinforcing member thereby allowing header assembly 126 to withstand greater fluid pressures without distortion as well as enabling lighter gauge materials to be used in construction thereof.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. In a heat exchanger of the fin and tube type, a header construction comprising:

a base member having first and second substantially parallel flange portions spaced apart a predetermined distance and an interconnecting portion;

said interconnecting portion having a plurality of integrally formed spaced smoothly tapered tubular projections adapted to telescopically nest with respective conduits of said heat exchanger, said tubular projections being arranged in a plurality of rows, each row containing a plurality of said tubular projections, said tapered tubular projections being operative to prevent the terminal end of said fluid conduit from projecting beyond the plane defined by said interconnecting portion, each of said tubular projections having a smoothly rounded shoulder portion at its juncture with said interconnecting member;

a cover member having first and second substantially parallel flange portions spaced apart a distance less than said predetermined distance and an interconnecting portion;

said first and second flange portions of said cover member being disposed and secured at a plurality of spaced locations in at least partially overlapping relationship with respective of said first and second flange portions of said base member;

a third flange portion;

a channel member;

means directly securing one of said third flange portion and said channel member to said interconnecting portion of said base member at a plurality of spaced apart locations between said tubular projections, means securing the other of said third flange portion and said channel member to said cover member, said third flange portion being received and sealingly secured within said channel; and sealing means securing adjacent portions of said first flange portions and adjacent portions of said second flange portions in fluid-tight relationship.

2. A heat exchanger comprising:

a heat exchanging core member having a plurality of fluid conducting conduit members surrounded by heat radiating fin members;

a pair of header members disposed at opposite ends of said fluid conduits, each of said header members including:

a base member having first and second generally parallel spaced flange portions, and an interconnecting portion extending generally perpendicularly therebetween, and a cover member having first and second generally parallel spaced flange portions and an interconnecting portion extending generally perpendicularly therebetween, said first and second flange portions of said base member being positioned in at least partially overlapping relationship to respective of said first and second flange portions of said cover members to hereby define a substantially enclosed chamber, a plurality of longitudinally spaced spot welds retaining said overlapping flange portions in close proximate relationship along the length thereof and securing means disposed between said overlapping flange portions and securing said overlapping flange portions in fluid-tight sealing relationship, one of said base members further including a plurality of outwardly extending divergingly tapered tubular projections integrally formed thereon, respective ones of said diverging tubular projections receiving one end of respective ones of said fluid conduits in telescopic relationship and being sealingly secured thereto, the other of said base members including a plurality of outwardly extending convergingly tapered tubular projections integrally formed thereon, respective ones of said converging tubular projections being telescopically received in the other end of respective ones of said fluid conduits and being sealingly secured thereto, each of said converging and diverging tubular projections having a smoothly radiused juncture with said base members and the converging and diverging taper of said tubular projections being operative to prevent said fluid conduits from projecting into the interior of said pair of header members so as to promote relatively smooth fluid flow into and out of respective of said header members.

3. A heat exchanger as set forth in claim 2 wherein said tubular projections provided on said pair of header members are sealingly connected to said conduit members by brazing.

4. A heat exchanger as set forth in claim 2 wherein one of said pair of header members includes means defining first and second chambers.

5. A heat exchanger as set forth in claim 4 wherein said chambers each extend longitudinally in said one header member and are disposed in side by side relationship.

6. A heat exchanger as set forth in claim 5 wherein said means defining first and second chambers comprises a third flange portion secured to a selected one of said cover member and said base member and a channel member secured to the other of said cover member and said base member, an outer end of said third flange portion being received in said channel member so as to divide said header into two chambers.

7. A heat exchanger comprising:

a plurality of elongated fluid conducting members, a header member including a cover member and a base member secured thereto, said cover member and said base member having first and second flange portions respectively, said first and second flange portions being positioned in spaced generally opposed relationship, a plurality of outwardly extending tapered tubular projections integrally formed on said second flange portion, said tubular projections being sealingly connected in fluid conducting relationship with said fluid conduits;

a third flange member;

an elongated channel member;

means directly securing said channel member to one of said first and second flange portions at a plurality of spaced locations;

means directly securing said third flange member to the other of said first and second flange portions in a position such that said third flange member is received within said channel member; and sealing means for creating a substantially sealing relationship between said channel member, said third flange member and said first and second flange portions.

8. A heat exchanger as set forth in claim 7 further comprising a rounded shoulder portion at the juncture of said tubular projections and said second flange portion, said rounded shoulder cooperating therewith to insure smooth fluid flow therebetween.

9. A heat exchanger as set forth in claim 8 wherein said tubular projections are secured in telescopic nested relationship with said fluid conducting members.

10. A heat exchanger as set forth in claim 7 wherein said tubular projections are outwardly divergingly tapered so as to telescopically receive said fluid conducting members therein.

11. A heat exchanger as set forth in claim 7 wherein said tubular projections are outwardly convergingly tapered so as to be telescopically received within said fluid conducting members.

* * * * *

UNITED STATES PATENT AND TRADEMARK OFFICE

CERTIFICATE OF CORRECTION

PATENT NO. : 4,381,033

DATED : April 26, 1983

INVENTOR(S) : Ivan D. Woodhull, Jr. and Thomas H. Liedel

It is certified that error appears in the above-identified patent and that said Letters Patent is hereby corrected as shown below: On the title page References Cited: Ireland et al., U. S. Patent No. 3,703,925 "11/1971" should be --11/1972--.

Abstract, line 10, "portions" should be -- portion--.

Abstract, lines 26, 27, "intermedite" should be --intermediate--.

Signed and Sealed this

*Twenty-first* Day of *June 1983*

[SEAL]

*Attest:*

DONALD J. QUIGG

*Attesting Officer*

*Acting Commissioner of Patents and Trademarks*